US010631073B2

(12) United States Patent
Schipper

(10) Patent No.: US 10,631,073 B2
(45) Date of Patent: Apr. 21, 2020

(54) MICROPHONE HOUSING WITH SCREEN FOR WIND NOISE REDUCTION

(71) Applicant: Intel Corporation, Santa Clara, CA (US)

(72) Inventor: Hans Schipper, Fonsorbes (FR)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/184,203

(22) Filed: Jun. 16, 2016

(65) Prior Publication Data

US 2017/0366889 A1 Dec. 21, 2017

(51) Int. Cl.
*H04R 1/08* (2006.01)
*H04R 1/04* (2006.01)

(52) U.S. Cl.
CPC ..... *H04R 1/086* (2013.01); *H04R 1/04* (2013.01); *H04R 2410/07* (2013.01); *H04R 2499/11* (2013.01); *H04R 2499/15* (2013.01)

(58) Field of Classification Search
CPC ..... H04R 1/086; H04R 1/04; H04R 2410/07
See application file for complete search history.

(56) References Cited

U.S. PATENT DOCUMENTS

| | | | | |
|---|---|---|---|---|
| 5,442,713 | A * | 8/1995 | Patel | H04R 1/086 379/431 |
| 6,118,881 | A * | 9/2000 | Quinlan | H04M 1/19 379/433.03 |
| 8,005,250 | B2 * | 8/2011 | Josephson | H04R 1/086 381/347 |
| 8,194,907 | B2 | 6/2012 | Kopnov et al. | |
| 2011/0103634 | A1 | 5/2011 | Maddern et al. | |
| 2012/0177239 | A1 * | 7/2012 | Lee | H04R 1/086 381/359 |
| 2014/0044297 | A1 * | 2/2014 | Loeppert | H04R 1/086 381/355 |
| 2014/0064542 | A1 * | 3/2014 | Bright | H04R 1/086 381/359 |
| 2014/0093095 | A1 * | 4/2014 | Slotte | H04R 1/02 381/87 |
| 2015/0023523 | A1 * | 1/2015 | Elian | H04R 1/083 381/91 |
| 2016/0337735 | A1 * | 11/2016 | Lim | H04R 1/086 |

* cited by examiner

*Primary Examiner* — Tuan D Nguyen
(74) *Attorney, Agent, or Firm* — International IP Law Group, P.L.L.C.

(57) ABSTRACT

A microphone housing is described with a screen for wind noise reduction. One example includes a housing defining a cavity and a surface on one side of the cavity, a mesh of holes through the surface into the cavity, and a microphone mounted inside the cavity.

20 Claims, 4 Drawing Sheets

MICROPHONE HOUSING WITH SCREEN FOR WIND NOISE REDUCTION

FIELD

The present description relates to a microphone housing and, in particular to a microphone housing with a screen for ambient sound pressure.

BACKGROUND

Powerful, low power processors allow for new functions to be added to old devices and for new devices to be created. Some of these functions relate to audio processing. Some tablet computers and smart phones are available with four separate microphones. These use significant audio processing to improve the audio. The multiple microphones may be used to provide audio recordings with a spatial aspect and the audio processing may be used to provide lower noise for monaural and multiple dimension recordings. Many devices offer voice control by capturing spoken statements from the user and either sending the captured audio to a remote server or processing the statements locally.

Multiple microphones are being added to wearable devices so that watches, helmets, glasses, and other worn apparel and apparatus may be used for recording, for communicating wirelessly with others in other locations, and for controlling devices using voice command. Hands free devices are being developed for training, maintenance, search and rescue and also for playing games either alone using voice commands or with multiple players using voice commands and conversation through a network.

For outdoor and industrial environments, wind can be a significant part of the audio field surrounding a microphone. The wind produces a flow of air that can cause a sustained sound pressure level (SPL) on the diaphragm of a microphone. Typically wind is also turbulent and inconsistent causing an irregular high level of SPL over time. Even on a calm day, when a user is bicycling, skiing, or motoring, wind may interfere with speech from the user or from others.

Wind flowing over a microphone will induce significant amounts of low frequency noise and can also introduce significant distortion. This is a problem for various types of voice transmission and sound recording systems. It is also a problem for digital speech encoding systems (CODECs), DSP (Digital Signal Processing) devices and other types of solutions inside communication devices. A DSP can provide significant enhancements to an audio signal for transmission, recording, or for application to an automatic speech recognition (ASR) system. These allow for better sounding audio or more easily understood voice. ASR requires a baseline level of quality over ambient noise in order to function reliably under adverse conditions. In particularly noisy and windy environments an ASR system may be unable to recognize many spoken statements.

The wind noise may be avoided by detecting vibrations on the user instead of vibrations carried as compression waves through the air. Bone conduction microphones sense vibrations in the skull, or nose to receive sound. These can be integrated into earpieces or headwear but require careful fitting to ensure physical acoustic coupling to the body. Throat microphones sense vibration through the neck caused by speaking. These types of microphones require physical contact with the speaker. Other speakers or ambient sounds cannot be suitably detected. In addition, the sensed vibrations do not include the full spectrum of the speech so that the sound is not suitable for recording or conversation and may be difficult to use in ASR.

BRIEF DESCRIPTION OF THE DRAWINGS

Embodiments are illustrated by way of example, and not by way of limitation, in the figures of the accompanying drawings in which like reference numerals refer to similar elements.

DETAILED DESCRIPTION

Figure 1:
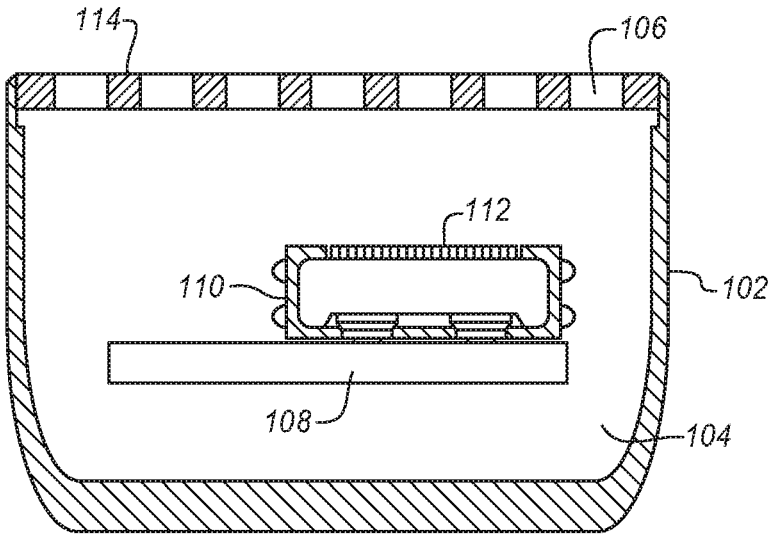
FIG. 1 is a cross-sectional side view diagram of a microphone integrated inside a housing according to an embodiment.

The present description relates to an incorporated system and method for mechanically reducing wind noise, preventing the full velocity of the wind and its turbulence from reaching a transducer, such as a microphone integrated in such a system. A windscreen design and microphone integration is described that is able to deliver high quality audio to a DSP, a recorder, and a transmitter under calm and windy conditions. Even in sustained, severe wind, the wind noise is significantly attenuated so that even ASR systems are able to function. Microphones have been protected from wind by using foam windscreens, basket-style windscreens, and other specific wind filter devices. These approaches normally require a large volume for wind isolation and foam material that degrades quickly. The described approach is small for use in compact devices and does not use a large amount of protective material, such as foam.

A windscreen is described that is mechanically incorporated into a compact or wearable device to reduce unwanted wind noise. The windscreen enhances sound pickup for communications and electronic devices, such as mobile telephones, computers, personal digital assistants, communication glasses, geographical positioning system (GPS) devices, cameras and video cameras. As described, the wind noise caused by the velocity of the wind and its turbulence is prevented from reaching the transducer or diaphragm of a microphone that is integrated into such a device.

This provides more integration headroom for sound pickup devices, e.g. MEMS (Micro-Electro-Mechanical System), or electret microphones, without placement restrictions and the usual rubber boot designs. The microphone may be closed very close to or far from an aperture on the surface of the housing. The placement may be selected for packaging or space concerns. The microphone may be placed on an existing PCB (Printed Circuit Board) or Flex Board inside the housing. There is no need for an additional rubber boot used to seal a microphone when it is positioned close to an aperture on a surface of the housing. This provides greater flexibility concerning component integration.

Traditional foam windscreens are large in volume so that the foam material is able to provide a suitable wind noise reduction effect. Thinner or smaller foam windscreens are less effective at reducing wind noise, so foam is not suitable for use in very small and compact communication devices. Traditional basket-style windscreens also impose an extra added volume in front of the microphone which makes them less suitable for very compact devices.

There are a variety of specific wind filter devices, such as perforated mesh and hydrophobic material that are positioned in front of the microphone and mounted on the surface of a housing that carries the microphone. These are not very effective in part because the materials are very small for very small microphones. The air flow caused by the wind is reduced only very little so these acoustic architectures are not effective with higher winds.

The techniques described herein avoid external attachments and extra external volume because the grid and windscreen of felt or open-cell foam can be integrated directly inside a housing. There is no need for extra rubber boots or sealing gaskets for the microphones. The microphone positioning is more flexible and the placement within the housing is not critical because of the acoustic nature of the housing. The rubber boots and sealing gaskets that are critical for a Helmholtz resonator effect are also avoided. Instead, the microphone may easily be integrated with other hardware.

FIG. 1 is a cross-sectional side view diagram of a microphone integrated inside a housing incorporating an integrated windscreen that is able to reduce wind noise without requiring foam or a significant volume. The housing is effective even for high velocity winds. The housing 102 is made of a solid material that defines a cavity 104 and that reflects sound within the cavity. The material is typically a solid metal or a plastic but other materials may be used instead. The housing has a surface 114 on one side of the cavity with an array of holes 106. These holes may be similar to conventional microphone holes used in portable devices and smart phones. The holes are in a pattern to form a mesh or screen configuration as shown in other views below. The arrangement of the holes may be designed to provide an aesthetic design, such as a logo, brand, symbol, or other picture. The holes may be round, rectangular, elongated, or any other shape that provides sufficient structural rigidity and acoustic transparency to the surface. In embodiments, 40% or more of the surface is removed by the holes, slots, or slits. In other words 60% or less of the surface is solid and acoustically opaque.

A microphone 110 is mounted inside the cavity. In this example, the microphone is mounted to a PCB 108 that is fixed inside the cavity with a mounting fixture (not shown). The mounting fixture has an attachment point on a wall of the cavity and the PCB extends from that attachment point into the interior of the cavity. The microphone has an acoustic diaphragm or membrane 112 shown pointing toward the mesh of holes in this example. However, the microphone may be pointed in any direction within the cavity. The microphone may be independent of a PCB so that is directly mounted to some other mounting fixture and then attached to other components using wires or other connectors.

With a single microphone hole, high wind velocities will introduce velocity and turbulence inside the microphone input hole. If the microphone membrane is mounted very close to the hole, then the wind produces significant distortion and may drive the microphone membrane into a nonlinear motion region. In the nonlinear motion region any received audio will be distorted making it more difficult to distinguish from the very loud wind noise.

On the other hand with a single microphone hole, if the microphone is mounted away from the hole within the cavity, then the cavity forms a resonant chamber. If the resonant frequency of the chamber is within the audible range then it will amplify audio within that range and reduce the amplitude of audio just outside the range. In addition, the sound pressure within the cavity will be about the same as on the outside of the cavity. This will result in a similar problem with noise and distortion as when the microphone is directly against the microphone hole. In addition, the resonant effects further reduce the sound quality.

Using the configuration of FIG. 1, there are many microphone holes 106 on one surface 114 of the housing to form a mesh or screen. In this example, the mesh surface is flat and on one side of the cavity. The cavity is roughly a rectangle in this cross-sectional side view diagram with the top side being the mesh surface and the three other sides being reflective of any audio. The overall shape is a cuboid that may have equal or unequal sides. The mesh may cover less than the whole surface on one side. The mesh is configured to be large enough to sufficiently reduce the sound pressure level (SPL) of the wind noise.

The surface with the mesh or grid of holes may be curved, arcuate, or flat as shown. The surface is a perforated region with many holes which are preferably no larger than 0.8 mm in diameter, although the holes may be larger. The mesh on the surface is configured so that it is acoustically transparent in relation to the total available surface.

The cavity is sized to avoid resonance for sounds that are to be transduced by the microphone. For sounds up to for example 4000 Hz, the cavity is no more than 8.4 cm in any one direction. This prevents acoustic resonance within the cavity from distorting the sound within the cavity. In some embodiments, the cavity is about 2-3 cm wide, 2-3 cm deep and 5-6 cm long. Different sizes and proportions may be used to suit different form factors for different implementations.

The mesh or grid of holes creates a greater level of openness within the cavity. At low wind velocities, the amplitude and frequency responses of a microphone to diaphragm movements are generally linear and distortion levels are low. Any noise created by a low level of wind may be diminished by common DSP wind noise processing. At higher wind velocities, there will still be significant velocity and turbulence in the microphone holes. With the multiple holes, however, the sound pressure level is distributed across the entire mesh surface and all of the holes. This will reduce the sound pressure level in the cavity significantly. In some embodiments, the larger surface with multiple holes reduces wind noise in the cavity by 12 dB. This allows the wind noise to be further corrected with common DSP wind noise processing.

The effect of expanding the standard single microphone input hole to become a mesh or screen of holes with many equivalent small holes is to spread the wind pressure over a larger surface. By moving the microphone inside the housing cavity, the wind pressure does not hit the microphone until it has been distributed across the screen of holes. The sound or pressure wave caused by a severe wind is scattered out over a larger surface, so that the final pressure ($P=N/m^2$ or Pressure=Force/Surface) inside the housing is lower. Only the pressure inside the cavity is picked-up by the microphone and this pressure is lower. The screen, mesh, or grid of holes also introduces a breathable surface in which the incident acoustic pressure can easily be compensated by the outside pressure.

In addition to spreading the pressure wave over a large surface, the screen also resists the flow of the pressure wave to the audio transducer. This is in contrast to conventional screens which serve only to provide physical protection to the transducer. The flow resistance of a single physical structure will vary with frequency and may be adapted to different configurations. In the examples shown and described herein a suitable flow resistance may be about 0.01% or higher at 100 Hz and about 0.25% or higher at 10,000 Hz. These frequencies are provided as approximate points on a line that extends through the audible range or the range of the transducer. The screen, mesh, or grid of holes may have at least 40% open area in relation to the solid area, allowing it to be largely transparent to ambient sound. The usable area for the screen and the configuration of the screen may be adapted to suit different designs and the maximum size of the surface available on a particular device available for a screen.

As described in more detail below, additional microphones may be added to the cavity. These may be mounted to the same PCB, a different PCB, or any other desired mounting fixture. The microphones may be spatially separated to support beam forming, beam steering, stereo recording, noise cancellation, and other techniques. As shown in FIG. 1, no rubber boots, sealing gaskets, wind foam, or other additional components required. These may be added to provide acoustic and other beneficial effects but are not required to sufficiently reduce the wind noise.

The described microphone housing and screen may be used to good effect in a hands free activity headset or terminal. The attenuation of wind noise is particularly helpful in outdoor and active settings. Communication devices, headsets, or terminals, used in both a hands free mode and simultaneously in a full duplex mode are more susceptible to acoustic coupling between the speakers and the microphones. Because of the hands free mode, the sound output and the sound input levels are both amplified by perhaps about 20 dB to account for the added distance to the user. In addition, because the user is not close to the speaker and the microphone, the user does not attenuate sound from the speakers that might strike the microphone. The performance of such a device may be enhanced by using the type of housing described in FIG. 1 for both the speakers and the microphones, or output and input transducers. These may be integrated inside a combined housing under sealed conditions.

Figure 2:
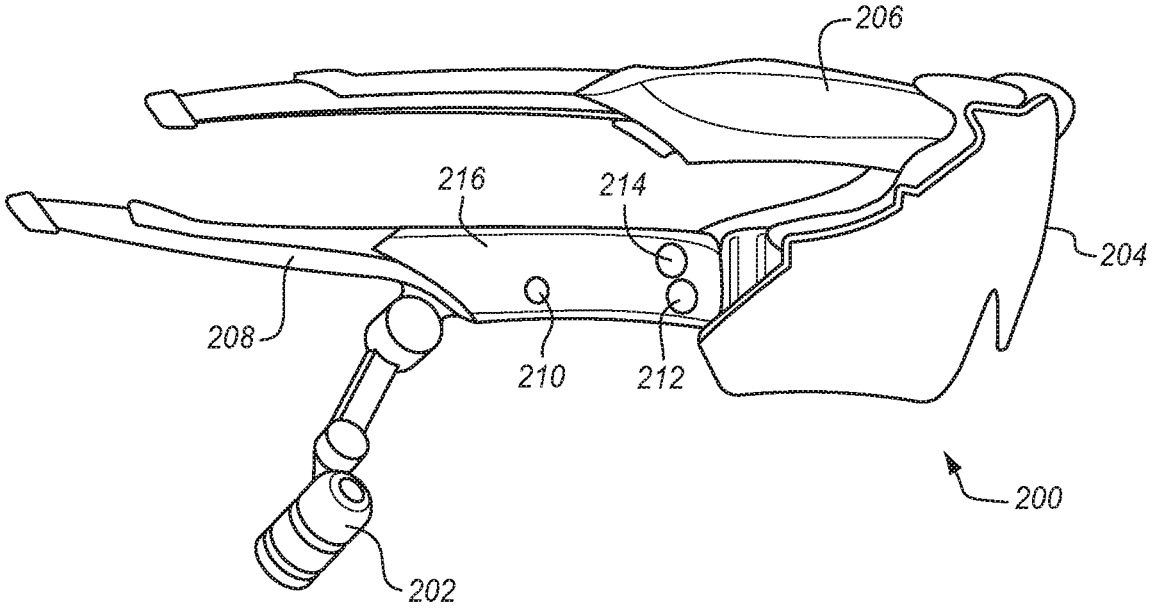
FIG. 2 is an isometric view of a wearable device with microphone and speakers using a housing and cavity according to an embodiment.
Figure 5:
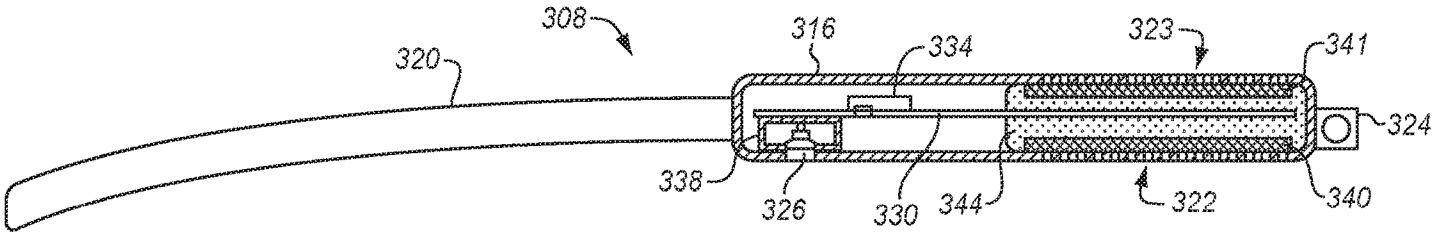
FIG. 5 is a cross-sectional top view diagram of an alternative left temple of the device of FIG. 2 according to an embodiment.

FIG. 2 is an isometric view of a wearable device with microphone and speakers using a housing and cavity as described above. This diagram shows a communication glasses device 200 in which earpiece microphones are mounted inside a closed housing. However the housing and cavity may be adapted to many other wearable, handheld, and fixed devices. In some cases, the microphones are mounted in a housing and the speaker is in an earbud 202. The earbud provides excellent acoustic decoupling between the speaker and microphones. As shown in FIG. 5, three microphones 210, 212, 214 or more may be integrated on the left temple or stem of the glasses.

The communication glasses of FIG. 2 have a single full-width lens 204 to protect the user's eyes. The lens serves as a frame including a bridge and nosepiece between the lenses, although a separate frame and nosepiece may be used to support lenses. The frame is attached to a right 206 and a left temple 208. The earbud 202 and the microphones are attached to the left temple. In this example, the communication glasses are configured to be used for running and bicycling at varying velocities, head angles and wind angles. The device may be adapted for use with other activities, such as skiing, boating, gaming, remote assisted equipment repair or medicine, etc.

The communication glasses may be configured as a standalone device with integrated radios for communication with cellular or other types of wide area communication networks. The communications glasses may include position sensors inertial sensors for navigation and motion inputs. Navigation, video recording, enhanced vision, and other types of functions may be provided with or without a connection to remote servers or users through wide area communication networks. In another embodiment, the communication glasses act as an accessory for a nearby wireless device. The user may also carry a smart phone or other communications terminal for which the communications glasses operate as a wireless headset. The communication glasses may also provide additional functions to the smart phone such as voice command, wireless display, camera, etc. These functions may be performed using a personal area network technology such as Bluetooth or Wi-Fi. In another embodiment, the communications glasses operate for short range voice communications with other nearby users and may also provide other functions for navigation, communications, or situational awareness.

Figure 8:
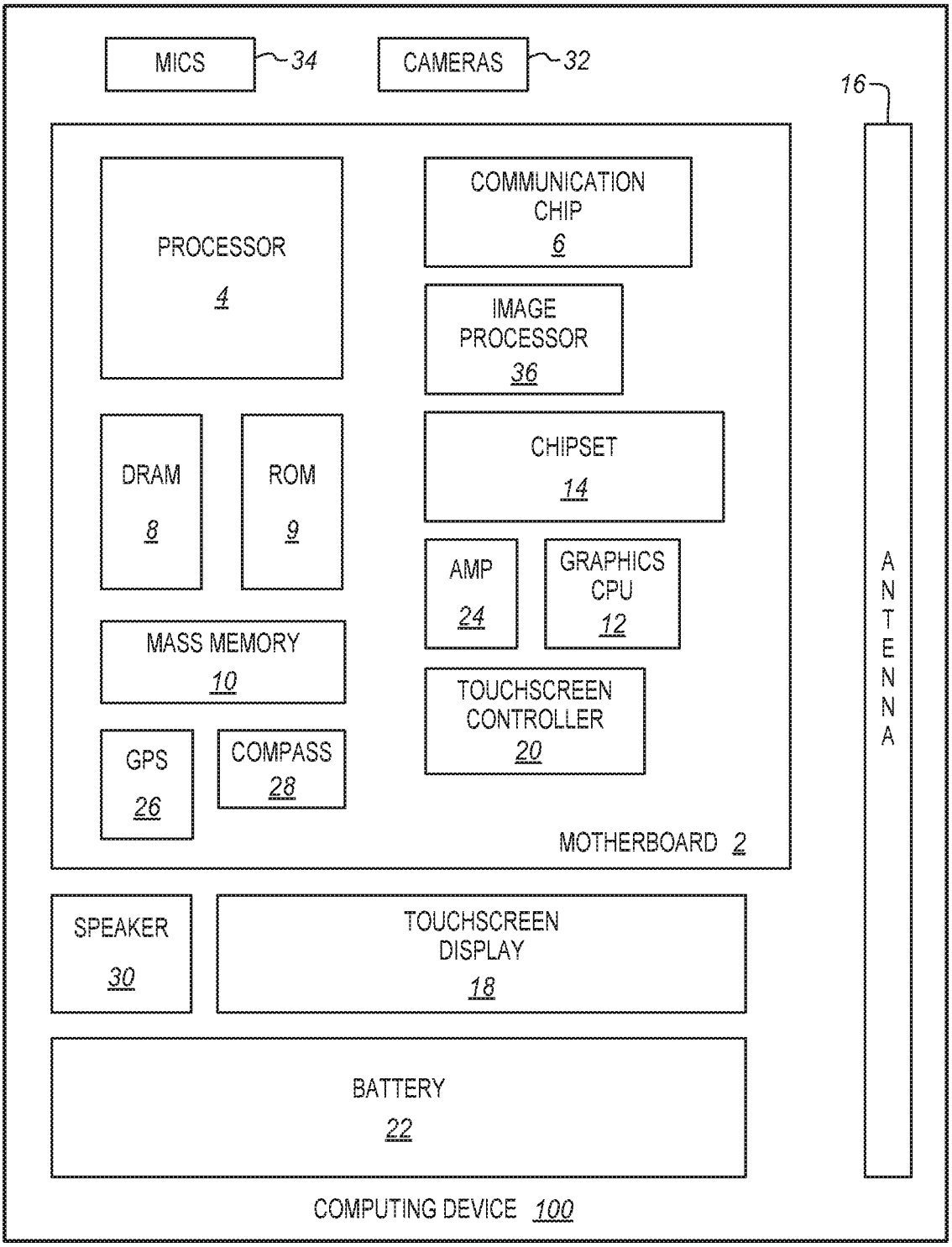
FIG. 8 is a block diagram of a computing device incorporating a microphone cavity and surface mesh according to an embodiment.

The display glasses include an internal processor and power supply such as a battery (shown in FIG. 8). The processor may communicate with a local smart device, such as a smart phone or with a remote service or both. The earbud 202 receives audio from the processor, optionally through a digital to audio converter and a power amplifier which may or may not be a part of the processor. The microphone or microphones are similarly coupled to the processor, optionally through an analog to digital converter and amplifier to provide user audio and ambient audio to the processor. The processor may include or be coupled to a memory to store received audio. The lens 204 may serve as eye protection and a frame only or may also be used as a display. The processor may generate graphics, such as alerts, maps, biometrics, and other data to display on the lens, optionally through a graphics processor and a projector.

With active outdoor activities, wind noise is incident on the microphone diaphragms or membranes. When the wind noise is too high, then the audio quality to the DSP is not good enough to allow for clear communications. The microphones and the housing permit the communications glasses to be used in sustained, severe winds, e.g. 25 to 55 km/h. In the illustrated communication glasses embodiment, the microphones are used to receive voice commands locally as well as to send voice to remote servers for voice recognition. The microphones are also used for telephone communications with other users. With high wind pressure the electrical output signal can completely overload the codec and the DSP inputs. A DSP can provide valuable incremental enhancements to an audio signal that will enable local or remote ASR (Automatic Speech Recognition) to function more reliably and will also deliver better-sounding voice under adverse conditions. However, if the microphones can't deliver acceptable baseline audio under severe wind noise then the DSP capabilities are exceeded. The described microphone cavity and grid is able to take ASR accuracy from 10% to 95% under severe wind conditions.

Figure 3:
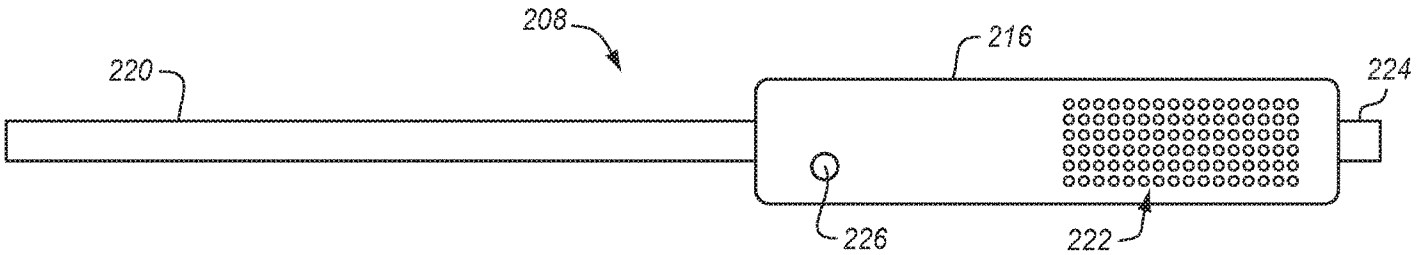
FIG. 3 is a side plan view of the left temple of the device of FIG. 2 according to an embodiment.

FIG. 3 is a side plan view of the left temple 208 of the communication glasses 200 of FIG. 2. The temple includes an earpiece or temple tip 220 that goes over the user's ear to hold the glasses in place at one end and a connector 224 to attach the temple to the lens or frame at the other end. The connector may include electrical connections to the lens or frame to connect with components on the frame and on the other temple, depending on the implementation. A housing 216 is attached between the earpiece and the connector. The earpiece is connected to the housing 216 attached to or integrated into the temple 208 that includes a microphone cavity and may also include other components such as microphone amplifiers, analog to digital converters (ADC), DSPs, a speaker amplifier, controllers, processors, communication components, a power supply, cameras, image projectors, etc. Some of these components may alternatively or additionally be carried by the right side temple 214. The housing has an earbud 202 output hole 226 for attaching an earbud or other speaker, and an incorporated windscreen or grid 222 over the microphone cavity.

Figure 4:
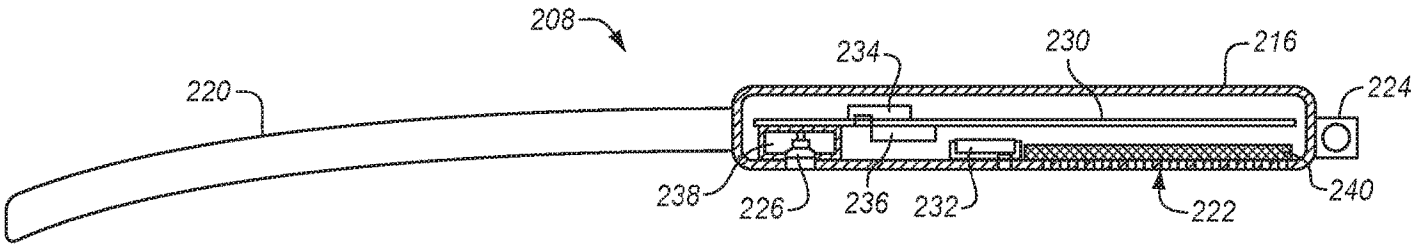
FIG. 4 is a cross-sectional top view diagram of the left temple of the device of FIG. 2 according to an embodiment.

FIG. 4 is a cross-sectional top view diagram of the left temple of the communications glasses of FIG. 2 showing the earpiece 220, the connector 224, and the housing in between the two. In this example, the connector has a threaded hole to allow it to be attached to connector on the frame using a screw. The housing includes a PCB 230 and MEMS microphones 234, 236 attached to the PCB. As shown, the microphones are on opposite side of the PCB in order to receive audio each from a different sound field. The microphones may be place in any of a variety of different positions to enhance spatial characteristics, noise cancellation and other effects. The microphones may be placed on the same or different PCBs.

As shown the PCB is located in a position offset from the two side walls of the housing. As a result, the microphones are roughly in the center of the cavity of the housing 216 and spaced apart from the two opposing walls. One microphone 236 faces the grid 222 and the other 234 faces the opposite side of the cavity away from the grid. This similar to the microphone placement in FIG. 1 in which the microphone is spaced apart from all of the walls of the housing.

The placement of the microphones is not critical and may be adapted to suit different fabrication technique and form factors. The spacing of the microphones may be adjusted to enhance particular types of performance, such as spatial diversity or noise cancellation. As shown the microphones are mounted directly to the PCB without rubber boots and sealing gaskets or other acoustic structures. The microphones may be mounted directly to any rigid or flexible structure including a flex board and a wall of the housing.

A third microphone 232 is optionally mounted on the surface of the housing immediately adjacent to the mesh 222. This third microphone is not facing the mesh as in a typical flush mount microphone but is facing opposite the direction of the mesh or toward the opposite side of the housing from the mesh surface. As a result, the microphone diaphragm will pick up sound waves that are inside the cavity and not sound waves that impinge directly on the mesh surface.

The PCB 230 is shown as mounted to a second cavity structure 238 within the cavity. The second cavity structure is attached to an interior of a wall of the housing, in this case the same surface that has the mesh. This structure 238 serves as an attachment point for the PCB within the cavity. As shown the PCB is mounted up above the walls of the cavity. While not visible in this top view, the PCB may be narrower than the cavity as seen from the side so that sound waves may easily move around the PCB within the cavity to reach all of the microphones.

The second cavity structure is open to the earbud hole 226 and contains a speaker to produce sound for the earbud. Alternatively, the speaker may be replaced by an audio amplifier to power an earbud transducer and the second cavity may be replaced with a simpler mounting bracket. The PCB may alternatively be mounted to a different part of the housing and in a different way. The microphones may also be direct surface mounted as in the example of the third microphone.

The mesh or screen 222 is optionally covered within the housing with a sound reducing felt mesh 240 or open cell foam or other acoustic baffle structure to further reduce wind noise within the cavity. The felt or foam also serves to protect the components within the cavity of the housing. There may be more or less foam depending on the particular operating environment of the microphone.

FIG. 5 is a cross-sectional top view diagram of an alternative left side temple for the communications glasses. The temple has an earpiece or temple tip 320 at one end, a connector 324 at the other end and a 308 has a housing 316 between the earpiece and the connector. The housing includes an earbud hole 326 to attach an earbud and a mesh of holes 322 through a surface of the housing into a cavity defined by the walls of the housing. A PCB or flex board 330 is attached to a mounting bracket 338 inside the housing and a microphone 334 is mounted to the PCB. There may be more microphones inside the housing mounted to the PCB, to the housing walls or to some other structure.

In the example of FIG. 5, there is a second mesh of holes 323 on a surface of the housing opposite the first mesh of holes 322. The second mesh of holes is similar in that it is formed for perforations or holes in a surface of the housing in which the holes are 0.8 mm or smaller and present a surface that is acoustically transparent to ambient sound. This second mesh allows sounds on the other side of the housing to more easily be captured by the microphone 334. In this case, the housing resembles a basket-style windscreen.

As in the example of FIG. 4, there is an optional sound reducing felt mesh or open cell foam 340, 341 across the surface of the mesh of holes. In this example, the felt mesh is on both sides of the housing to cover both meshes. An additional optional hydrophobic mesh 344 is placed between the two grids 322, 323 and between the two layers of sound reducing felt mesh 340, 341. The additional hydrophobic mesh may be in the form of an open cell foam to increase the wind noise reduction level. All or some of the available volume inside the housing may be filled with the open cell foam. Two types of materials may be used, such as the felt foam adjacent the surface grids and the open cell foam between the felt foam layers or a single material may be used within the housing as one or more pieces. The open cell foam may be, for example a melamine with a nominal density of 11 kg/m3 or more. The additional foam may also be optionally used to fill the cavity of FIG. 4 either partially or completely.

The unique temple housings of FIGS. 2-5 have been compared to flush mount microphone configurations and are able to provide a wind noise rejection of more than 10 dB even in wind speeds of over 25 km/h. ASR accuracy is also significantly improved.

The described housing, grid, and microphone configurations may be used inside all sorts of communications and electronic devices and is particularly useful for outdoor and industrial uses with moderate wind noise environments at 25 km/h or more.

Figure 6:
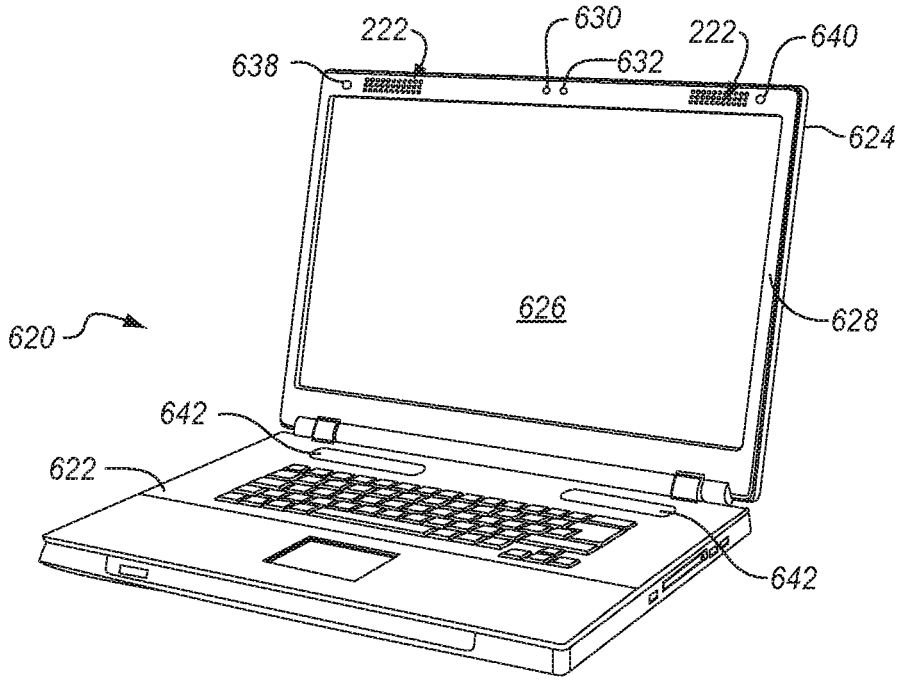
FIG. 6 is an isometric diagram of a portable device with microphone cavity and surface mesh according to an embodiment

FIG. 6 is an isometric diagram of a portable device suitable for use with the microphone cavity and surface mesh as described herein. This device is a notebook, convertible, or tablet computer 620 with attached keyboard. The device has a display section 624 with a display 626 and a bezel 628 surrounding the display. The display section is attached to a base 622 with a keyboard and speakers 642. The bezel is used as a location to mount a camera 630 and a white flash or lamp 632. The bezel is also used to house one or more microphone housing with cavities 638, 640. In this example the microphones are separated apart to provide a spatial character to the received audio. Each cavity may have one or more microphones and more or fewer microphone housings may be used depending on the desired cost and audio performance. The ISP, graphics processor, CPU and other components are typically housed in the base 622 but may be housed in the display section, depending on the particular implementation.

This computer may be used as a conferencing device in which remote audio is played back through the speakers 642 and remote video is presented on the display 626. The computer receives local audio at the microphones 638, 640 and local video at the camera 630. The white LED 632 may be used to illuminate the local user for the benefit of the remote viewer.

Figure 7:
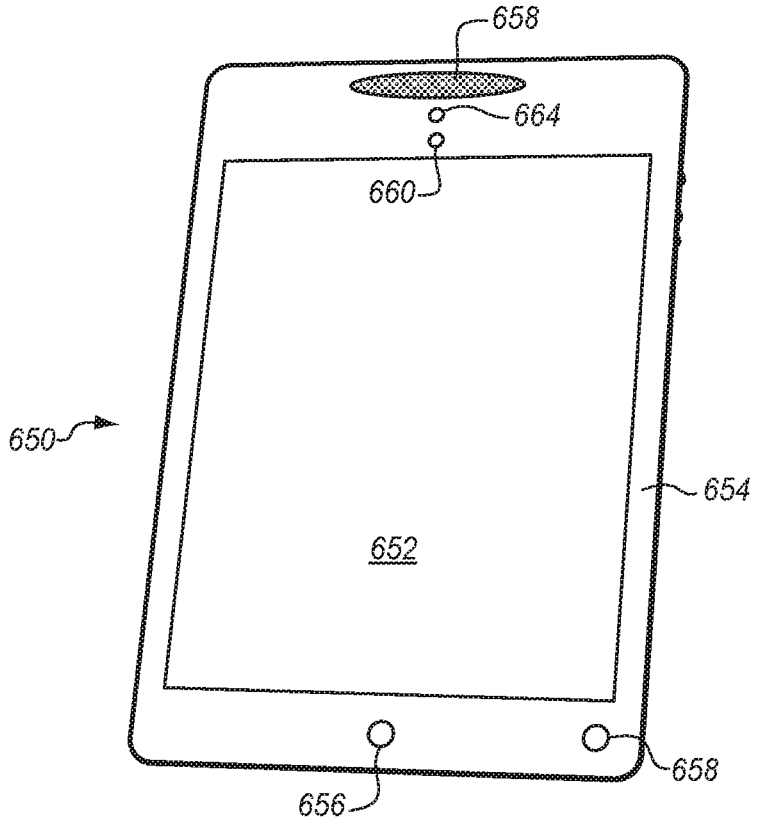
FIG. 7 is an isometric diagram of a tablet or phone with a microphone cavity and surface mesh according to an embodiment

FIG. 7 shows a similar device as a portable tablet or smart phone. A similar approach may be used for a desktop monitor or a wall display. The tablet or monitor 650 includes a display 652 and a bezel 654. The bezel is used to house the various audiovisual components of the device. In this example, the bottom part of the bezel below the display houses two microphones 656, 658 each in corresponding housing with a surface mesh as described above. The top of the bezel above the display houses a speaker 658. This is a suitable configuration for a smart phone and may also be adapted for use with other types of devices. The bezel also houses a camera 660 and a white LED 664. The various processors and other components discussed above may be housed behind the display and bezel or in another connected component.

The particular placement and number of the components shown may be adapted to suit different usage models. More and fewer microphones, speakers, and LEDs may be used to suit different implementations. Additional components, such as proximity sensors, rangefinders, additional cameras, and other components may also be added to the bezel or to other locations, depending on the particular implementation.

The video conferencing nodes of FIGS. 6 and 7 are provided as examples but different form factors such as a helmet, sports goggles, a headset, a desktop workstation, a wall display, a conference telephone, an all-in-one or convertible computer, and a set-top box form factor may be used, among others. The microphone housings may be located in a separate housing from the display and may be disconnected from the display bezel, depending on the particular implementation. In some implementations, the display may not have a bezel. For such a display, the microphones, cameras, speakers, LEDs and other components may be mounted in other housings that may or may not be attached to the display.

In another embodiment, the microphones are mounted to a separate housing possibly also with cameras and speakers to provide a remote communications device that receives sound in different environments in a compact enclosure. A separate communications interface may then transmit the received audio and images, if any to another location for recording and viewing.

FIG. 8 is a block diagram of a computing device 100 in accordance with one implementation. The computing device 100 houses a system board 2. The board 2 may include a number of components, including but not limited to a processor 4 and at least one communication package 6. The communication package is coupled to one or more antennas 16. The processor 4 is physically and electrically coupled to the board 2.

Depending on its applications, computing device 100 may include other components that may or may not be physically and electrically coupled to the board 2. These other components include, but are not limited to, volatile memory (e.g., DRAM) 8, non-volatile memory (e.g., ROM) 9, flash memory (not shown), a graphics processor 12, a digital signal processor (not shown), a crypto processor (not shown), a chipset 14, an antenna 16, a display 18 such as a touchscreen display, a touchscreen controller 20, a battery 22, an audio codec (not shown), a video codec (not shown), a power amplifier 24, a global positioning system (GPS) device 26, a compass 28, an accelerometer (not shown), a gyroscope (not shown), a speaker 30, cameras 32, a microphone array 34, and a mass storage device (such as hard disk drive) 10, compact disk (CD) (not shown), digital versatile disk (DVD) (not shown), and so forth). These components may be connected to the system board 2, mounted to the system board, or combined with any of the other components.

The communication package 6 enables wireless and/or wired communications for the transfer of data to and from the computing device 100. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication package 6 may implement any of a number of wireless or wired standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, Ethernet derivatives thereof, as well as any other wireless and wired protocols that are designated as 3G, 4G, 5G, and beyond. The computing device 100 may include a plurality of communication packages 6. For instance, a first communication package 6 may be dedicated to shorter range wireless communications such as Wi-Fi and Bluetooth and a second communication package 6 may be dedicated to longer range wireless communications such as GPS, EDGE, GPRS, CDMA, WiMAX, LTE, Ev-DO, and others.

The microphones 34 may be mounted in housings as described herein and coupled to audio processing resources of the processor or another dedicated processing component. There may be multiple housings and multiple microphones per housing, depending on the implementation. The microphones may be placed in a separate housing together with other selected components such as speakers, cameras, inertial sensors and other devices that is connected by wires or wirelessly with the other components of the computing system. The separate component may be in the form of a wearable device or a portable device.

The computing device may be fixed, portable, or wearable. In further implementations, the computing device 100 may be any other electronic device that processes data or records data for processing elsewhere. In various implementations, the computing device 100 may be a laptop, a netbook, a notebook, an ultrabook, a smartphone, a tablet, a personal digital assistant (PDA), an ultra mobile PC, a mobile phone, a desktop computer, a server, a set-top box, an entertainment control unit, a digital camera, a portable music player, or a digital video recorder.

Embodiments may be implemented using one or more memory chips, controllers, CPUs (Central Processing Unit), microchips or integrated circuits interconnected using a motherboard, an application specific integrated circuit (ASIC), and/or a field programmable gate array (FPGA).

References to "one embodiment", "an embodiment", "example embodiment", "various embodiments", etc., indicate that the embodiment(s) so described may include particular features, structures, or characteristics, but not every embodiment necessarily includes the particular features, structures, or characteristics. Further, some embodiments may have some, all, or none of the features described for other embodiments.

In the following description and claims, the term "coupled" along with its derivatives, may be used. "Coupled" is used to indicate that two or more elements co-operate or interact with each other, but they may or may not have intervening physical or electrical components between them.

As used in the claims, unless otherwise specified, the use of the ordinal adjectives "first", "second", "third", etc., to describe a common element, merely indicate that different instances of like elements are being referred to, and are not intended to imply that the elements so described must be in a given sequence, either temporally, spatially, in ranking, or in any other manner.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

The following examples pertain to further embodiments. The various features of the different embodiments may be variously combined with some features included and others excluded to suit a variety of different applications. Some embodiments pertain to a microphone assembly that includes a housing defining a cavity and a surface on one side of the cavity, a mesh of holes through the surface into the cavity, and a microphone mounted inside the cavity.

In further embodiments the holes comprise over 40% of the surface of the cavity.

In further embodiments the mesh has a flow resistance to acoustic waves of at least 0.01% at 100 Hz.

In further embodiments the cavity has a shortest dimension that is shorter than an anticipated shortest acoustic wavelength to be transduced by the microphone.

In further embodiments the cavity has a rectangular cross-section.

In further embodiments the housing has walls to define the cavity and the microphone is mounted at a position spaced apart from all of the walls.

Further embodiments include a printed circuit board that is attached to a wall of the housing inside the cavity and that extends from the attachment into the cavity and wherein the microphone is attached to the printed circuit board spaced apart from the attachment.

In further embodiments the microphone is on one side of the printed circuit board, the assembly including a second microphone attached to an opposite side of the printed circuit board.

In further embodiments the holes are smaller than 0.8 mm in diameter.

In further embodiments the mesh of holes is acoustically transparent.

Further embodiments include a sound reducing foam over the mesh of holes inside cavity.

In further embodiments the foam is a felt foam.

In further embodiments the foam is an open cell foam.

In further embodiments the foam fills the cavity.

Some embodiments pertain to an apparatus that includes means for defining a cavity having a surface on one side of the cavity, means for permitting air flow through the surface into the cavity, and means for transducing the airflow into electrical signals inside the cavity.

In further embodiments the means for defining has walls to define the cavity, the apparatus further comprising means for mounting the means for transducing at a position spaced apart from all of the walls.

Further embodiments include means for attaching a printed circuit board to a wall of the housing inside the cavity that extends from an attachment into the cavity and wherein the means for transducing is attached to the printed circuit board spaced apart from the attachment point.

Some embodiments pertain to a system that includes a processor, a speaker coupled to the processor to deliver audio generated by the processor to a user, a power supply to power the processor and the audio, and a microphone coupled to the processor to receive user audio and provide it to the processor, the microphone being mounted in a housing that defines a cavity and a surface on one side of the cavity, the surface having a mesh of holes through the surface into the cavity.

In further embodiments the holes comprise over 40% of the surface of the cavity.

In further embodiments the mesh has a flow resistance to acoustic waves of at least 0.01% at 100 Hz.

What is claimed is:

1. A microphone assembly comprising:

a housing defining a cavity, the housing having a planar and rigid surface on one side of the cavity, wherein audio is reflected within the cavity;

a mesh of holes integrated into the planar and rigid surface of the housing defining the cavity and providing an opening from outside of the housing to inside of the cavity; and a microphone having a diaphragm that is mounted inside the cavity defined by the housing and located in a position offset from side walls of the housing, wherein the diaphragm picks up sound waves reflected inside the cavity and not sound waves that impinge directly on the mesh of holes and wherein a sound inlet is perpendicular to the diaphragm.

2. The assembly of claim 1, wherein the holes comprise over 40% of the surface of the cavity.

3. The assembly of claim 1, wherein the mesh has a flow resistance to acoustic waves of at least 0.01% at 100 Hz.

4. The assembly of claim 1, wherein the cavity is defined by walls and wherein the cavity has a shortest dimension across the cavity from one wall to another wall that is shorter than an anticipated shortest acoustic wavelength to be transduced by the microphone.

5. The assembly of claim 1, wherein the cavity has a rectangular cross-section.

6. The assembly of claim 1, wherein the housing has walls to define the cavity and the microphone is mounted at a position spaced apart from all of the walls.

7. The assembly of claim 6, further comprising a printed circuit board that is attached to a wall of the housing inside the cavity at an attachment point and that extends from the attachment point into the cavity and wherein the microphone is attached to the printed circuit board spaced apart from the attachment point.

8. The assembly of claim 7, wherein the microphone is on one side of the printed circuit board, the assembly further comprising a second microphone attached to an opposite side of the printed circuit board.

9. The assembly of claim 1, wherein the holes are smaller than 0.8 mm in diameter.

10. The assembly of claim 1, wherein the mesh of holes is acoustically transparent.

11. The assembly of claim 1, further comprising a sound reducing foam over the mesh of holes inside the cavity.

12. The assembly of claim 11, wherein the foam is felt foam.

13. The assembly of claim 11, wherein the foam is an open cell foam.

14. The assembly of claim 11, wherein the foam fills the cavity.

15. An apparatus comprising:

means for defining a cavity having a planar and rigid surface on one side of the cavity, wherein audio is reflected within the cavity;

means for permitting air flow through the planar and rigid surface into the cavity including a plurality of holes, wherein the means for permitting air flow is integrated into the means for defining the cavity and each hole is visible providing an opening from outside the flat and rigid surface to inside of the cavity; and means for transducing the airflow into electrical signals that is mounted inside the cavity and located in a position offset from side walls of the housing, wherein the means for transducing the airflow picks up sound waves reflected inside the cavity and not sound waves that impinge directly on the means for permitting air flow and wherein a sound inlet is perpendicular to the means for transducing the airflow.

16. The apparatus of claim 15, wherein the means for defining has walls to define the cavity, the apparatus further comprising means for mounting the means for transducing at a position spaced apart from all of the walls.

17. The apparatus of claim 16, further comprising means for attaching a printed circuit board to a wall of the housing inside the cavity that extends form an attachment point into the cavity and wherein the means for transducing is attached to the printed circuit board spaced apart from the attachment point.

18. A system comprising: a processor;

a speaker coupled to the processor to deliver audio generated by the processor to a user; a power supply to power the processor and audio; and a microphone coupled to the processor to receive user audio and provide it to the processor, the microphone having a diaphragm that is mounted in a housing that defines a cavity, wherein audio is reflected within the cavity, and the housing having a planar and rigid surface on one side of the cavity, a mesh of holes integrated into the planar and rigid surface of the housing defining the cavity, wherein the diaphragm is located in a position offset from side walls of the housing, wherein the diaphragm picks up sound waves reflected inside the cavity and not sound waves that impinge directly on the mesh of holes and wherein a sound inlet is perpendicular to the diaphragm.

19. The system of claim 18, wherein the holes comprise over 40% of the surface of the cavity.

20. The system of claim 18, wherein the mesh has a flow resistance to acoustic waves of at least 0.01% at 100 Hz.

* * * * *